US007278539B2

(12) United States Patent
Souza

(10) Patent No.: US 7,278,539 B2
(45) Date of Patent: Oct. 9, 2007

(54) SPORTS EQUIPMENT BAG

(76) Inventor: John C. Souza, 420 E. Forest Hills Dr., Phoenix, AZ (US) 85022

( * ) Notice: Subject to any disclaimer, the term of this patent is extended or adjusted under 35 U.S.C. 154(b) by 547 days.

(21) Appl. No.: 10/920,063

(22) Filed: Aug. 17, 2004

(65) Prior Publication Data

US 2006/0037877 A1 Feb. 23, 2006

(51) Int. Cl.
*B65D 85/20* (2006.01)
*A45C 7/00* (2006.01)

(52) U.S. Cl. ..... 206/315.1; 190/107; 190/108; 190/110; 190/111; 190/114; 206/579

(58) Field of Classification Search ..... 206/315.1, 206/315.9, 315.3, 579; 190/107–114, 903
See application file for complete search history.

(56) References Cited

U.S. PATENT DOCUMENTS

| | | | | | |
|---|---|---|---|---|---|
| 2,244,887 | A | * | 6/1941 | Manley | 312/6 |
| 3,010,775 | A | | 11/1961 | Giovannelli | |
| 3,994,372 | A | * | 11/1976 | Geller et al. | 190/107 |
| 4,793,532 | A | * | 12/1988 | Cash | 224/584 |
| 4,984,906 | A | * | 1/1991 | Little | 383/4 |
| 5,042,664 | A | | 8/1991 | Shyr et al. | |
| 5,224,602 | A | | 7/1993 | Bettles et al. | |
| 5,265,719 | A | | 11/1993 | Wand | |
| 5,337,907 | A | * | 8/1994 | McKenzie et al. | 211/88.01 |
| 5,845,780 | A | | 12/1998 | Allen | |
| 6,039,474 | A | * | 3/2000 | DeChant | 383/66 |
| 6,164,425 | A | * | 12/2000 | Latshaw | 190/18 A |
| 6,334,519 | B1 | * | 1/2002 | Tong | 190/107 |
| 6,732,863 | B2 | | 5/2004 | Speck | |
| 7,044,277 | B2 | * | 5/2006 | Redzisz | 190/107 |
| 2002/0074199 | A1 | | 6/2002 | Albritton | |
| 2005/0011785 | A1 | * | 1/2005 | Nish | 206/315.1 |

OTHER PUBLICATIONS

Battyshack Dugout Organizer, www.battyshack.com, Apr. 29, 2004.
Designated Hanger, www.kuzsports.com, Apr. 29, 2004.
Advertisements from Buy-Sports Equipment.com, 6 pages, Apr. 29, 2004.

* cited by examiner

*Primary Examiner*—Jila M Mohandesi
(74) *Attorney, Agent, or Firm*—John D. Titus

(57) ABSTRACT

A portable enclosure for storing and carrying baseball and other athletic equipment consists of six fabric-covered rigid panels which can be closed by means of a single continuous zipper to form a rigid rectangular parallelepiped that can be carted easily by means of wheels located at a lower edge. When the portable enclosure is unzipped into the open position, the back wall and side walls open up flat so that the pockets, shelves and pouches located on the interior surfaces thereof are accessible. Yet, since the portable enclosure is now flat, it can be located out of the way, secured against the back of the dugout where it will not create a trip hazard for the players.

9 Claims, 6 Drawing Sheets

SPORTS EQUIPMENT BAG

BACKGROUND OF THE INVENTION

The present relates generally to storage and carrying devices and, more particularly, to bags for organizing and carrying athletic equipment such as baseball bats, gloves, balls, helmets and catcher's equipment.

Athletes commonly use bags for transporting athletic equipment to and from the practice field and games. In the case of little league baseball, the duty of transporting team equipment such as bats, balls, batting helmets and catcher's equipment often falls on the little league coach. State of the art equipment for transporting little league equipment currently falls into two general categories, bags and carts. Little league equipment bags are generally little more than a large duffel bag into which helmets, bats, balls, and other equipment are stuffed and lugged over the shoulder onto the field. Once located in the dugout, the bag must be unloaded and the equipment arranged so that it is readily accessible to the players, yet out of the way so as not to form a trip hazard in the narrow dugout.

Little league equipment carts, on the other hand, typically resemble an upright shopping cart. Although the little league equipment cart relieves the coach of the burden of lugging a heavy duffel bag fall of equipment, it is bulky and, once in the dugout, the equipment cart is typically too deep front-to-back to be positioned in the dugout without creating a trip hazard for the players.

What is needed therefore, is an athletic equipment storage and transport cart that stores and organizes equipment in a closed position, and then is capable of being opened into a flat configuration for organizing the athletic equipment out of the way against the back of the dugout.

SUMMARY OF THE INVENTION

The above and other advantages are provided by a portable enclosure for storing and carrying athletic equipment which, in a closed position, forms a rigid cart having a closed interior volume, which can be opened into a flat, open position. In a preferred embodiment, the portable enclosure comprises six fabric covered rigid panels, namely a back panel, a front panel, a top panel, a bottom panel and two side panels. The right side panel is stitched to the back panel to form a flexible seam between the back panel and right side panel. Similarly, the front panel is stitched to the right side panel and the left side panel stitched to the front panel. The top and bottom panels are similarly stitched to the back panel. In the closed position, the side and front panels are folded around the back panel along their seams to form a rigid rectangular parallelepiped, the ends of which are closed by the top and bottom panels, respectively. A single continuous zipper closes the seam formed by the panels beginning with the seam between the right side panel and the bottom panel and ending with the seam between the right side panel and the top panel. In the closed position, the portable enclosure is rigid and therefore, with the provision of "luggage" wheels along the lower edge of the back panel, the portable enclosure can be carted to and from the playing field. When the portable enclosure is unzipped into the open position, the back wall and side walls open up flat so that the pockets, shelves and pouches located on the interior surfaces thereof are accessible. Yet, since the portable enclosure is now flat, it can be located out of the way, secured against the back of the dugout where it will not create a trip hazard for the players.

BRIEF DESCRIPTION OF THE DRAWING

The present invention will be better understood from a reading of the following detailed description, taken in conjunction with the accompanying drawings figures in which like references designate like elements and, in which.

DETAILED DESCRIPTION

Figure 1:
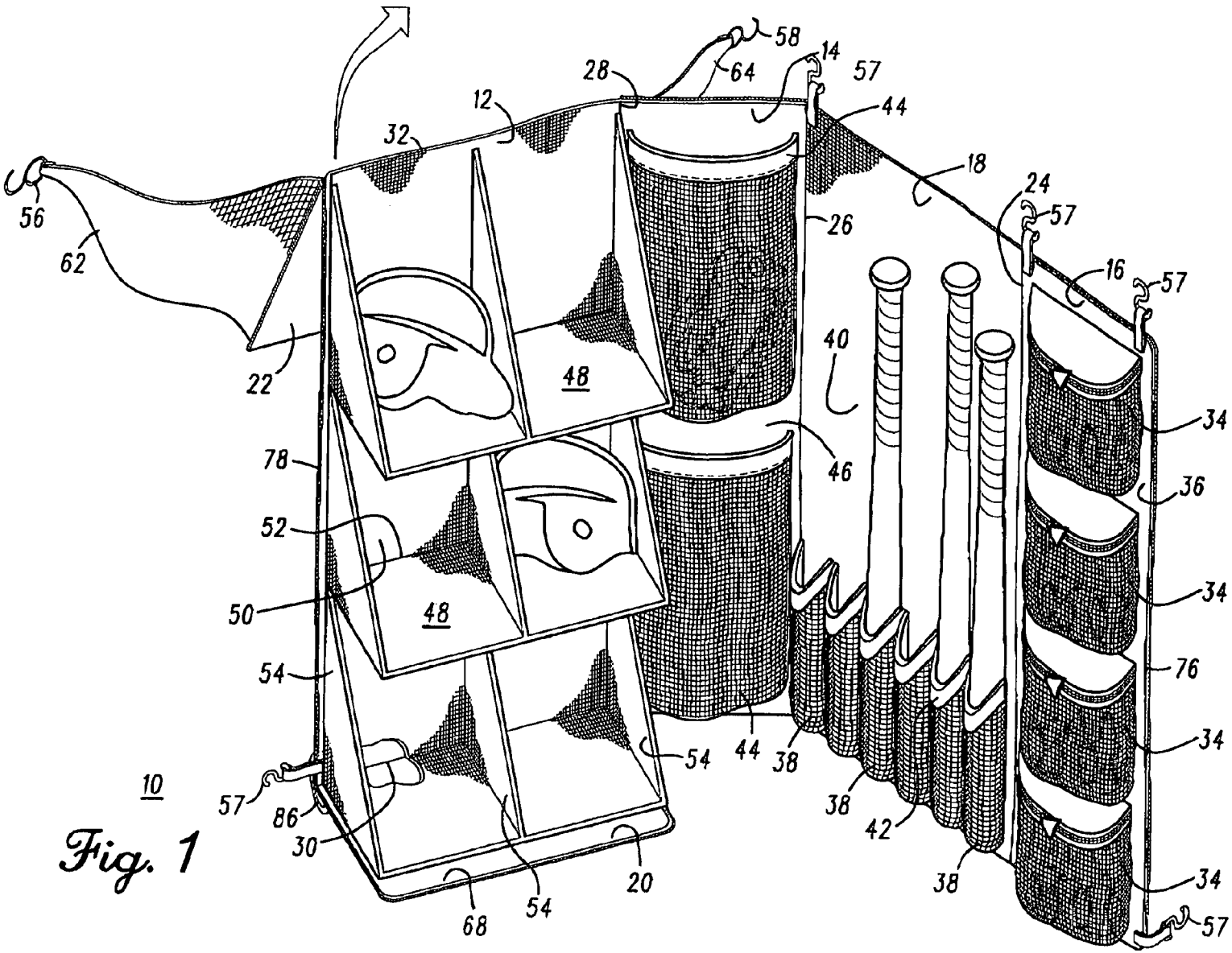
FIG. 1 is a perspective view of a portable enclosure incorporating features of the present invention in the open position.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed but are merely illustrative and intended to teach one of ordinary skill how to make and/or use the invention claimed herein and for setting forth the best mode for carrying out the invention.

Figure 2:
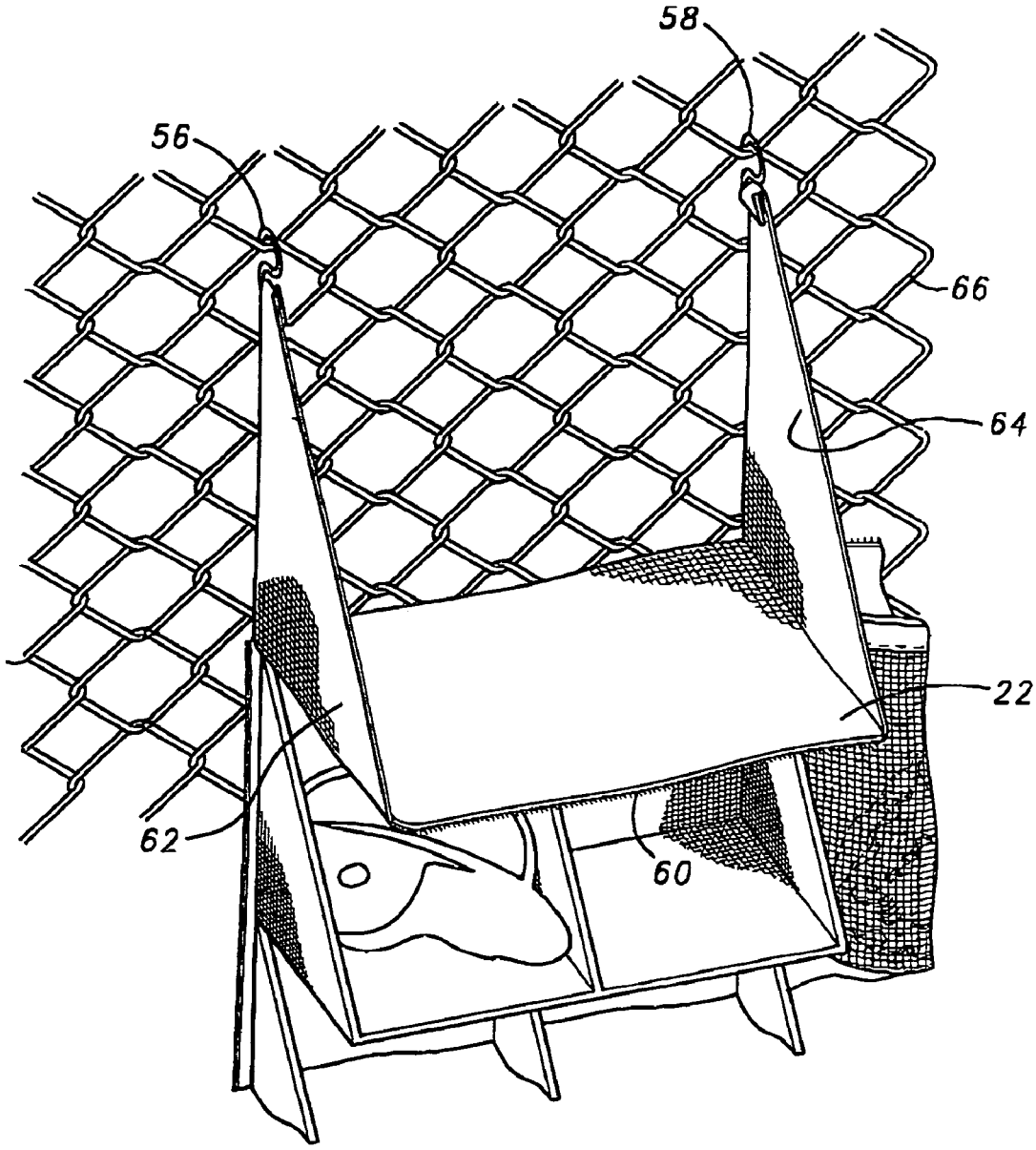
FIG. 2 is a partial perspective view of the portable enclosure of FIG. 1 in an installed condition.

With reference to FIGS. 1 and 2, an illustrative embodiment of portable enclosure 10 incorporating features of the present invention includes six panels comprising a back wall 12, side walls 14 and 16, front wall 18, bottom wall 20 and top wall 22. In the illustrative embodiment of FIG. 1, each of back wall 12, side wall 14, side wall 16, front wall 18, bottom wall 20 and top wall 22 are lightweight rigid panels hinged together. Preferably, back wall 12, side wall 14, side wall 16, bottom wall 20 and top wall 22 are fabricated by stitching individual inserts made from a rigid cardboard, polymer or particleboard into a continuous piece of nylon, polypropylene, or other water-resistant synthetic fabric covering the front and back of the rigid inserts. Front and back sides of the fabric are then stitched together between the rigid inserts to create hinge members 24, 26, 28, 30, and 32. Hinge member 24 hinges side wall 16 to front wall 18. Hinge member 26 hinges front wall 18 to side wall 14. Hinge member 28 hinges side wall 14 to back wall 12. Hinge member 30 hinges bottom wall 20 to back wall 12; and hinge member 32 hinges top wall 22 to back wall 12. Although in the illustrative embodiment all six panels are rigid, in order to save weight, one or more walls, such as the top wall 20 may be made of flexible fabric only.

In the preferred embodiment, a plurality of zippered pouches 34 are disposed along the interior surface 36 of side wall 16. Zippered pouches 34 can be utilized to store balls, water bottles, or other small equipment. A plurality of elongate pockets 38 are disposed on inner surface 40 of front wall 18. Elongate pouches 38 are each sized to accept a single baseball bat (e.g. pouches 38 open to a maximum of 2-⅝ inch and are a maximum of 36 inches long) and are optionally provided with an elastic member such as elastic members 42 at the pocket opening to hold the bat securely. Large pouches 44 are attached to inner surface 46 of side wall 14. Large pouches 44 are sized to hold large equipment such as catcher's knee pads and chest protector (e.g., 7-14 inches wide by 21-25 inches tall). Zippered pouches 34, elongate pouches 38 and Large pouches 44 are all of conventional construction (e.g., stitched fabric, elastic, and mesh material).

Shelves 48 are disposed on inner surface 50 of back wall 12. Preferably shelves 48 are of identical construction to walls 12-22, e.g., a rigid insert stitched within a fabric enclosure. Shelves 48 are stitched to inner surface 50 along seams 52 which permit shelves 48 to fold in flat against inner surface 50 of back wall 12. Shelves 48 are preferably supported in the horizontal orientation shown in FIG. 1 (with portable enclosure 10 in the open position) by means of a plurality of flexible fabric gussets 54 which are stitched to shelves 48 and inner surface 50. Gussets 54 support shelves 48 and also serve as partitions to divide shelves 48 into compartments sized to hold a batting helmet as well as preventing the contents of shelves 48 from falling off the sides of the shelf. Although flexible gussets are used in the preferred embodiment, other supports such as fabric straps, cord or other flexible supports connecting shelves 48 to back wall 12 may be used in place of gussets 54. In a preferred embodiment, the lowermost of shelves 48 is omitted in favor of using bottom wall 20 as a shelf.

As shown most clearly in FIG. 2, hanging means such as hooks 56 and 58 are attached to inner surface 60 of top wall 22 by fabric gussets 62 and 64. Hooks 56 and 58 are adapted to hook over a chain link fence 66 of the type commonly found at little league baseball fields. Although hooks 56 and 58 are shown in the illustrative embodiment, any means of temporarily attaching portable enclosure 10 to a supporting structure, such as straps secured by hook-and-loop fasteners, snaps, buttons or other fasteners would be suitable and therefore are considered within the scope of the present invention. As can be determined from FIGS. 1 and 2, in the open position, portable enclosure 10 can be opened so that back wall 12, front wall 18 and side walls 14 and 16 lay flat against the chain link fence 66 at the back of a baseball dugout, and extend into the dugout only as far as shelves 48 are deep (i.e., approximately the width of a batter's helmet). Fabric gussets 62 and 64, which may be inelastic or elastic, hold top wall 22 horizontal to form an additional shelf, while holding enclosure 10 upright with the weight of the contents of enclosure 10 resting on the ground. As with gussets 54, although fabric gussets 62 and 64 are used in the preferred embodiment, other supports such as fabric straps, cord or other flexible supports connecting top wall 22 to a supporting structure may be used in place of gussets 62. Additional hanging means such as hooks 57 may be disposed along the perimeter of enclosure 10 for added stability when secured to a supporting structure. One or more of side walls 14 and 16, back wall 12, front wall 18 and top wall 22 may have mesh panels to promote air circulation. Additionally, small pockets extending into the interior of enclosure 10 suitable for keys and other valuables as well as clear sleeves to accommodate sponsor logos and the like may be provided on the exterior surface. Finally, one or more of gussets 54, 62 and 64 may include a pouch for a first aid kit.

Figure 3:
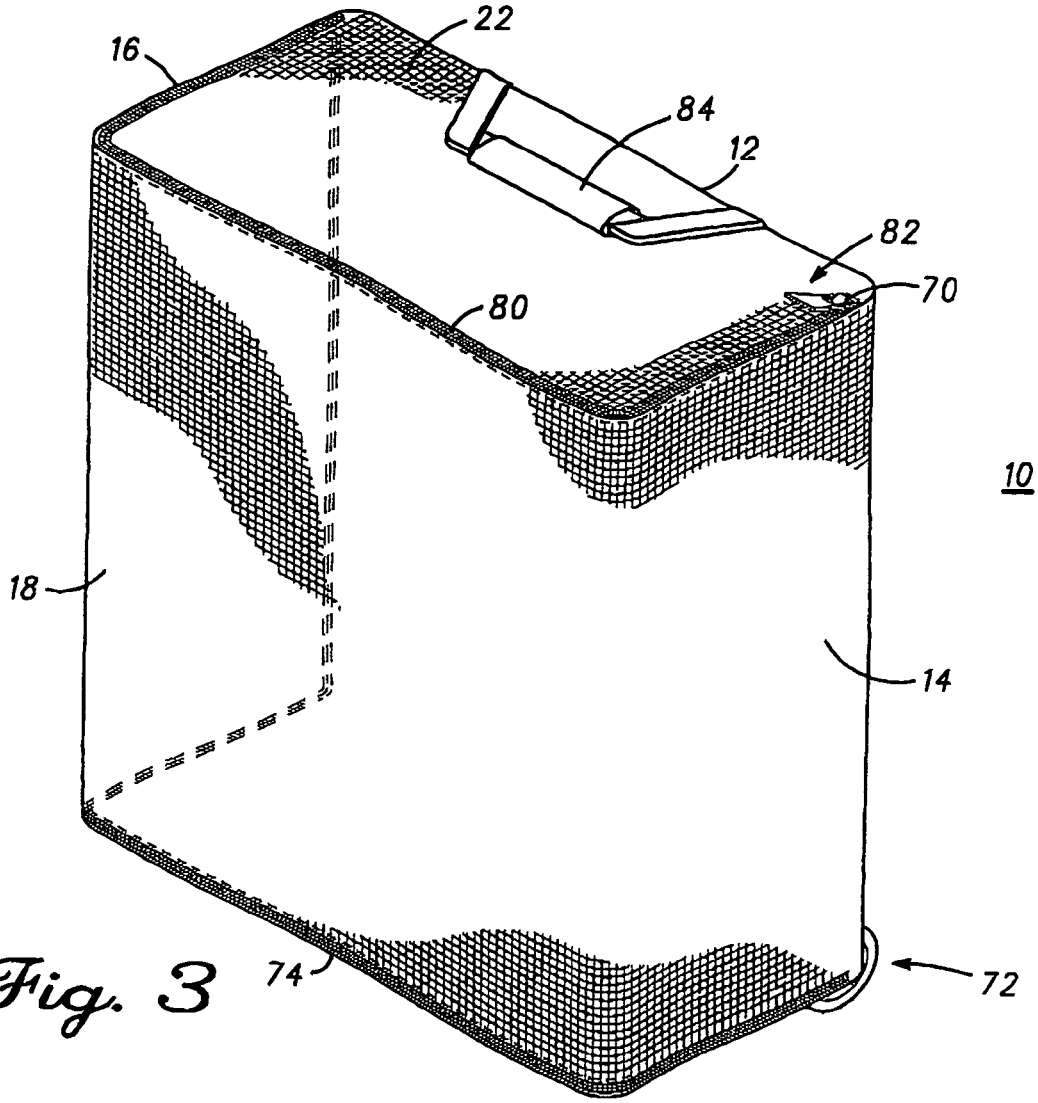
FIG. 3 is a perspective view of the portable enclosure of FIG. 1 in a closed position.
Figure 4:
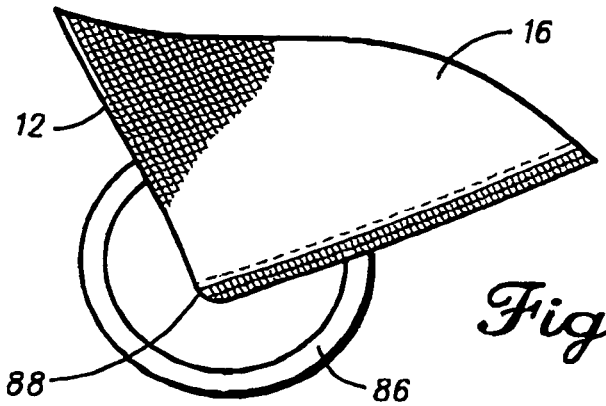
FIG. 4 is an enlarged fragmentary view of the luggage wheel portion of the portable enclosure of FIG. 1.

With reference to FIGS. 3 and 4, portable enclosure 10 is moved into the closed position shown in FIG. 3 by folding side wall 14 in toward back wall 12, front wall 18 in toward side wall 14 and side wall 16 in toward front wall 18 so that portable enclosure 10 assumes the generally rectangular parellelapiped shape shown in FIG. 3. Top wall 22 and bottom wall 20 are then folded inward such that the inner surfaces 36, 40, 46 and 60 along with inner surface 68 of bottom wall 20 form a closed interior volume with shelves 48 folded upward against inner surface 50 of back wall 12. Sufficient room is available to store the batting helmets within the volume defined by inner surfaces 36, 40, 46, 50, 60 and 68 once shelves 48 are folded inward. It should be noted that the exposed perimeter 74 of bottom wall 20 is equal to the combined widths of side wall 14, front wall 18 and side wall 16. Similarly, the exposed perimeter 80 of top wall is also equal to the combined widths of side wall 14, front wall 18 and side wall 16. This relationship permits portable closure 10 to be sealed by means of a continuous zipper 70 running from the lower corner 72 at the bottom edge of hinge member 28 around the perimeter 74 of bottom wall 20 thereby joining bottom wall 20 to side wall 14, front wall 18 and side wall 16. Zipper 70 continues up the side of portable enclosure 10 joining edge 76 of side wall 16 to edge 78 of back wall 12 then continues around the perimeter 80 of top wall 22 coming to an end at upper corner 82 at the uppermost end of hinge member 28. Although a zipper 70 is used in the illustrative embodiment, other means of closing portable enclosure 10 such as hook and loop fasteners, snaps, hooks, or other apparatus for temporarily joining two pieces of fabric together would be suitable and therefore would be considered within the scope of the present invention. Once closed, portable enclosure 10 becomes a rigid box which can be transported easily by lifting handle 84, tilting portable enclosure 10 on its side and carting it on a pair of wheels 86 located on the bottom edge 88 of back wall 12.

Figure 9:
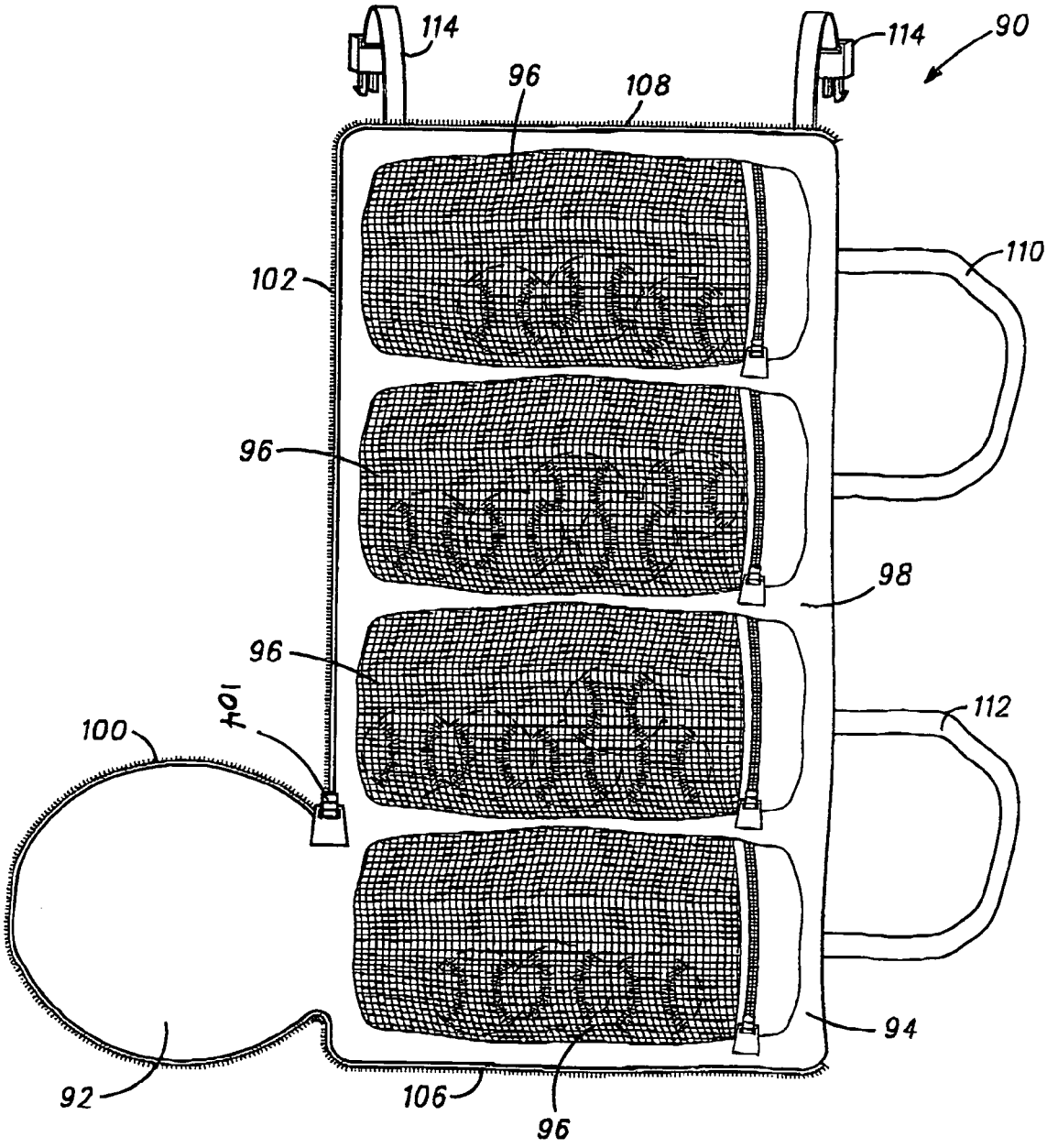
FIG. 9 is a front view of a ball compartment for use in connection with the portable enclosure of FIG. 1 in the open position.
Figure 10:
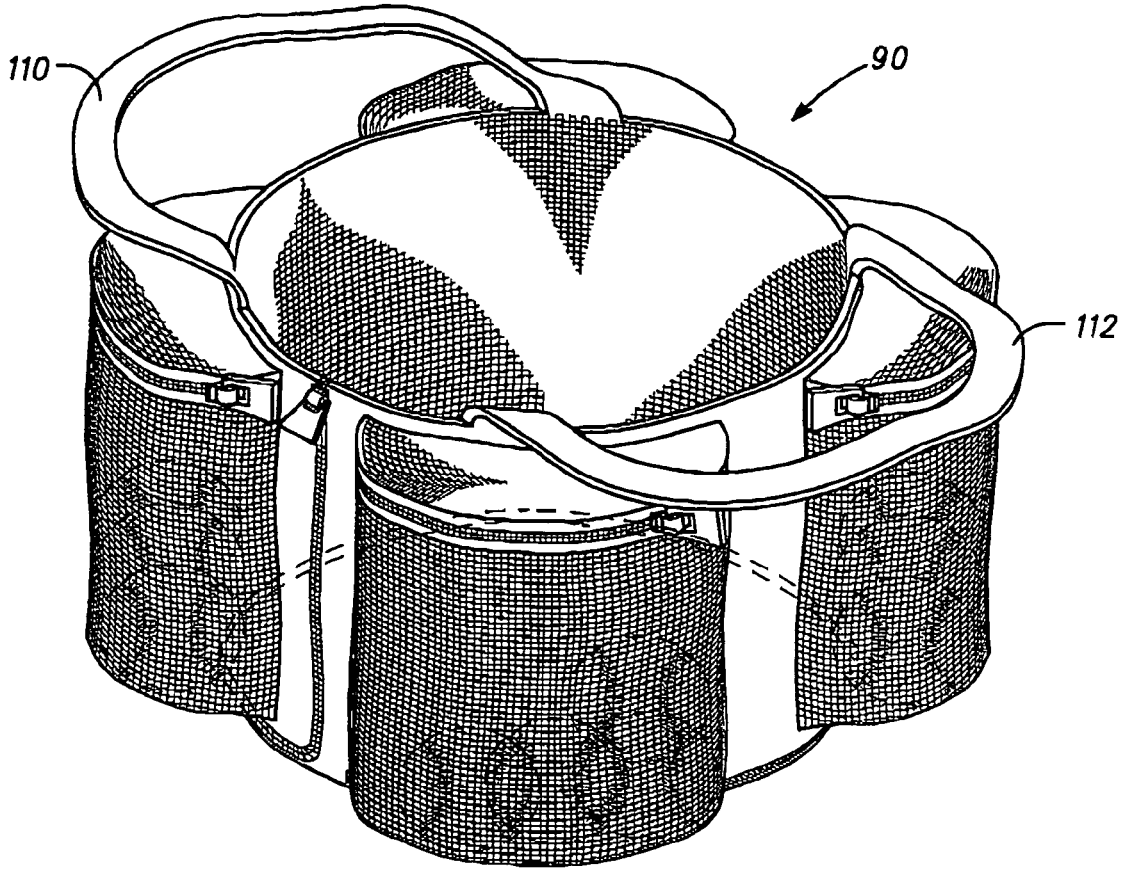
FIG. 10 is a perspective view of the ball compartment of FIG. 9 in the closed position.

With reference to FIGS. 9 and 10, in lieu of zippered pouches 34, enclosure 10 may be equipped with a ball compartment 90 comprising a base 92 and a wall 94 composed of nylon, polypropylene, or other water-resistant synthetic fabric. A plurality of zippered pockets 96, suitable for holding balls, water bottles, and other items are attached to interior surface 98 of wall 94. Zippered pockets 96 are all of conventional construction (e.g., stitched fabric, elastic, and mesh material). A plurality of fastening devices such as hook and loop fasteners, hooks or, preferably a pair of clips 114 located at edge 108 of wall 94 may be used to hang ball compartment 90 from one of side walls 14 or 16 inside enclosure 10. Optionally, clips 114 may be located at edge 106 of wall 94.

The free perimeter 100 of base 92 is the same length as edge 102 of wall 94. This permits ball compartment 90 to be closed into the cylindrical configuration shown in FIG. 10 by means of a continuous zipper 104 that seals perimeter 100 of base 92 to edge 102, then continues upward sealing edges 106 and 108 of wall 94 together. Once in the cylindrical "bucket" shape as shown in FIG. 10, ball compartment 90 can be carried independent of enclosure 10 by means of fabric handles 110 and 112. Although in the illustrative embodiment base 92 is circular, base 92 may be in the form of a rectangle, hexagon, or other shape as long as the free perimeter of base 92 is equal in length to a side of wall 94, such that the compartment is capable of being zipped closed in substantially the same manner. Where base 92 is a polygon, wall 94 may have rigid inserts equal in number to the sides of the polygonal base and similar in construction to walls 12-18 of enclosure 10. Thus constructed, in the closed configuration, the ball compartment 90 is rigid and may be inverted and used as a seat, as is common among little league coaches.

Figure 5:
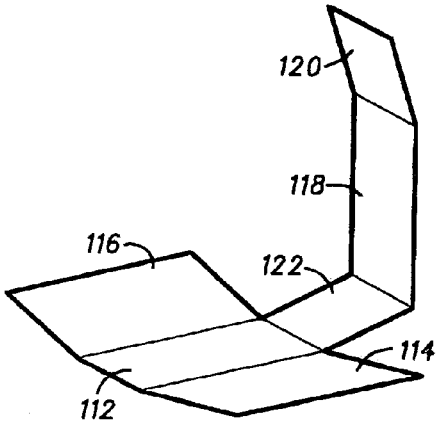
FIG. 5 is a schematic representation of an alternative embodiment of the portable enclosure of FIG. 1.
Figure 6:
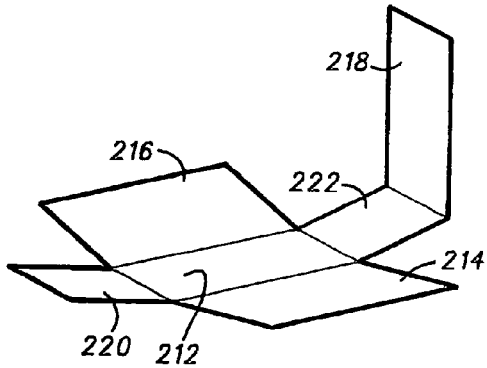
FIG. 6 is a schematic representation of another alternative embodiment of the portable enclosure of FIG. 1.
Figure 7:
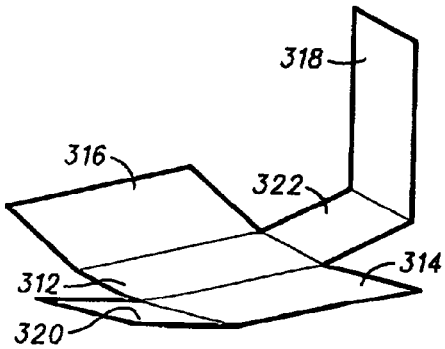
FIG. 7 is a schematic representation of yet another alternative embodiment of the portable enclosure of FIG. 1.
Figure 8:
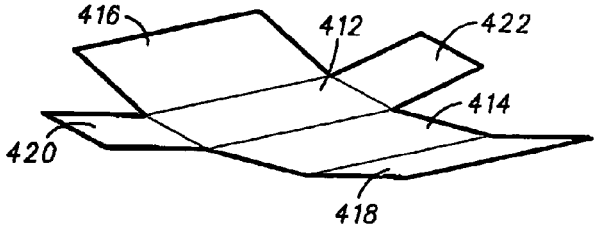
FIG. 8 is a schematic representation of yet another alternative embodiment of the portable enclosure of FIG. 1.

Although certain illustrative embodiments and methods have been disclosed herein, it will be apparent from the foregoing disclosure to those skilled in the art that variations and modifications of such embodiments and methods may be made without departing from the spirit and scope of the invention. For example, although in the illustrative embodiment of FIGS. 1-4 side wall 16 is joined to front wall 18 which is joined to side wall 14 which is joined to back wall 12, other enclosures that are moveable from a flat open position into a substantially rectangular closed box position are considered within the scope of the present invention. For example, as shown in FIG. 5, side walls 114 and 116 may be hinged to back wall 112 with bottom wall 120 hinged to front wall 118 hinged to top wall 122, hinged to back wall 112. In another alternative embodiment, side walls 214 and 216 are hinged to back wall 212, front wall 218 is hinged to top wall 222, which is hinged to back wall 212, and bottom wall 220 is separately hinged to back wall 212. In another alternative embodiment as shown in FIG. 7, side walls 314 and 316 are hinged to back wall 312. Front wall 318 is hinged to top wall 322, which is hinged to back wall 312. Bottom wall 320 is separately hinged to side wall 314. In yet another alternative embodiment, as shown in FIG. 8, side walls 414 and 416 as well as top wall 422 and a bottom wall 420 are hinged to back wall 412. Front wall 418 is then hinged to side wall 414 in a manner similar to the illustrative embodiment of FIGS. 1-4. Accordingly, it is intended that the invention should be limited only to extent required by the appended claims and the rules and principals of applicable law.

What is claimed is:

1. A portable enclosure for storing and carrying athletic equipment comprising:

six walls secured together along a plurality of flexible hinges, said six walls capable of being moved between a closed position forming a closed interior volume bounded by the interior surfaces of said six walls and an open position permitting access to plural of said interior surfaces of said six walls, at least four of said six walls comprising substantially rigid rectangular panels and at least five of said six walls having at least one free edge when said portable enclosure is in said open position;

said six walls comprising a top wall, a back wall, a first side wall, a second side wall, a front wall and a bottom wall, said first side wall being hingedly attached to said back wall, said front wall being hingedly attached to one of said first side wall, and said top wall, said top wall being hingedly secured to one of said back wall, said first side wall and said second side wall, and said bottom wall being hingedly attached to one of said first side wall, said second side wall, said back wall and said top wall;

means for securing said six walls in said closed position;

means for suspending said six walls from a supporting surface in said open position;

and a plurality of rigid shelves hingedly attached along a fixed edge to one of said back wall, said first side wall and said second side wall, plural of said plurality of rigid shelves being supported in a substantially horizontal orientation when said portable enclosure is in said open position by a plurality of flexible side supports attached between said plurality of rigid shelves and said one of said back wall, said first side wall and said second side wall.

2. The portable enclosure of claim 1, wherein:

side plurality of flexible side supports comprise a plurality of flexible fabric gussets.

3. The portable enclosure of claim 1, further comprising:

a plurality of pockets attached to an interior surface of at least one of said back wall, said first side wall, said second side wall and said front wall at least one of said plurality of pockets capable of holding a bat in a vertical orientation when said portable enclosure is supported in an upright orientation.

4. The portable enclosure of claim 1, wherein:

said front wall is hingedly attached to said first side wall; and said second side wall is hingedly attached to said front wall.

5. The portable enclosure of claim 1, wherein:

said front wall is hingedly attached to said first side wall; and said second side wall is hingedly attached to said back wall.

6. A portable enclosure for storing and carrying athletic equipment comprising:

six walls secured together alone a plurality of flexible hinges, said six walls capable of being moved between a closed position forming a closed interior volume bounded by the interior surfaces of said six walls and an open position permitting access to plural of said interior surfaces of said six walls, at least four of said six walls comprising substantially rigid rectangular panels and at least five of said six walls having at least one free edge when said portable enclosure is in said open position;

said six walls comprising a top wall, a back wall, a first side wall, a second side wall, a front wall and a bottom wall, said first side wall being hingedly attached to said back wall, said front wall being hingedly attached to one of said first side wall, and said top wall, said top wall being hingedly secured to one of said back wall, said first side wall and said second side wall, and said bottom wall being hingedly attached to one of said first side wall, said second side wall, said back wall and said top wall;

means for securing said six walls in said closed position;

means for suspending said six walls from a supporting surface in said open position; and a ball compartment releasably attached to an interior wall of said portable enclosure, said ball compartment comprising a base and a rectangular wall attached to said base, the base of said ball compartment having a perimeter equal in length to an adjacent side of said rectangular wall such that said ball compartment is capable of being closed with said adjacent side of said rectangular wall abutting said perimeter of said base and a pair of edges of said rectangular wall perpendicular to said adjacent side abutting each other.

7. A portable enclosure for storing and carrying athletic equipment comprising:

six panels substantially rectangular in shape, each having an interior surface and an exterior surface;

five flexible hinge members, each of said five flexible hinge members joining one of said six panels to another of said six panels along a common edge, the remaining fourteen edges of said six panels being free to move about said flexible hinge members such that said six panels are moveable into a closed position in which each of the fourteen free edges abuts another of said fourteen free edges to form a single continuous seam and the exterior surfaces of said six panels form a substantially rectangular parallelepiped having a closed interior volume formed by the interior surfaces of said six panels, said six panels further also being moveable about said flexible hinge members into an open position in which the exterior surfaces of at least four of said six panels are substantially coplanar and the interior surfaces of all of said six panels are accessible, means for releasably closing said single continuous seam;

a plurality of pockets disposed on at least one of said inside surfaces of said six panels, a plurality of rigid shelves hingedly attached along a fixed edge to one of said six panels plural of said plurality of rigid shelves;

a plurality of flexible side supports attached between said plurality of rigid shelves and said one of said six panels for supporting said plurality of rigid shelves in a substantially horizontal orientation when said portable enclosure is in said open position; and hanging means for suspending said portable enclosure in said open position from a supporting surface.

8. The portable enclosure of claim 7, further comprising:

a ball compartment releasably attached to an interior wall of said portable enclosure, said ball compartment comprising a base and a rectangular wall attached to said base, the base of said ball compartment having a perimeter equal in length to an adjacent side of said rectangular wall such that said ball compartment is capable of being closed with said adjacent side of said rectangular wall abutting said perimeter of said base and a pair of edges of said rectangular wall perpendicular to said adjacent side abutting each other.

9. The portable enclosure of claim 7, wherein:

said plurality of pockets includes at least one elongate pocket capable of holding a baseball bat in a vertical orientation when said portable enclosure is suspended by said hanging means.

* * * * *

UNITED STATES PATENT AND TRADEMARK OFFICE

CERTIFICATE OF CORRECTION

PATENT NO. : 7,278,539 B2
APPLICATION NO. : 10/920063
DATED : October 9, 2007
INVENTOR(S) : John C. Souza It is certified that error appears in the above-identified patent and that said Letters Patent is hereby corrected as shown below:

Column 1, line 26, “fall” should be changed to --full--
Column 6, line 28 for claim 6, “alone” should be changed to --along--.

Signed and Sealed this

Twenty-seventh Day of November, 2007

JON W. DUDAS
*Director of the United States Patent and Trademark Office*